United States Patent [19]

Evans

[11] 4,319,588

[45] Mar. 16, 1982

[54] APPARATUS AND METHOD FOR CIGARETTE ROLLING AND HOLDING

[76] Inventor: Henry J. Evans, 14113 San Antonio Dr., Norwalk, Calif. 90650

[21] Appl. No.: 155,138

[22] Filed: Jun. 2, 1980

[51] Int. Cl.[3] ..... A24B 5/00

[52] U.S. Cl. ..... 131/280; 131/329; 131/58

[58] Field of Search ..... 131/15 R, 58 R, 15 A, 131/4 A, 4 R, 20 R, 8 R, 260

[56] References Cited

U.S. PATENT DOCUMENTS

| | | | |
|---|---|---|---|
| 19,746 | 3/1858 | Blanchard | 131/58 X |
| 680,003 | 8/1901 | Simering | 131/58 X |
| 2,525,548 | 10/1950 | Herman | 131/58 |
| 4,033,358 | 7/1977 | Harrington | 131/260 X |

FOREIGN PATENT DOCUMENTS

| | | | |
|---|---|---|---|
| 386925 | 1/1933 | United Kingdom | 131/58 |

*Primary Examiner*—Stephen C. Pellegrino
*Attorney, Agent, or Firm*—Poms, Smith, Lande & Rose

[57] ABSTRACT

A reusable device for rolling a cigarette from a generally rectangular cigarette paper and for holding the rolled cigarette during consumption thereof includes a rigid elongated member disposed along a longitudinal edge of the paper, and a crimping member for engaging a transverse edge of the paper. The elongated member provides a rolling guide for the cigarette, longitudinally strengthens the cigarette after rolling, and also provides a holder for the cigarette as the elongated member is exposed as the cigarette is consumed by smoking. The crimping member is adjacent the elongated member and prevents movement thereof during the rolling and the smoking of the cigarette. The elongated and crimping members may be integrally formed of a thin, rigid, and elongated wire of low heat conductivity having a hook at one end.

3 Claims, 3 Drawing Figures

APPARATUS AND METHOD FOR CIGARETTE ROLLING AND HOLDING

FIELD OF THE INVENTION

The present invention generally relates to cigarette rolling and holding devices and, in particular, to reusable devices for the manual rolling and holding of cigarettes.

BACKGROUND OF THE INVENTION

The cigarettes commercially available today do not provide the exotic blends of tobacco preferred by many smokers. Such smokers generally purchase their tobacco and cigarette papers separately and individually prepare their cigarettes. While cigarette rolling machines are commercially available, many smokers prefer to prepare their cigarettes in a completely manual fashion, wherein a cigarette paper is manually rolled around a portion of tobacco.

Such manually-prepared cigarettes, however, suffer from several deficiencies. First, the cigarette papers commercially available are generally much thinner than the papers used in the commercial cigarette brands, thereby providing the manually prepared cigarette with little longitudinal support. Second, the manually-prepared cigarettes do not come equipped with the filters used by the commercial cigarette manufacturers, thereby eliminating the mouthpiece for the cigarette provided by the filters. Accordingly, in the final stages of the consumption of the cigarette, the cigarette must be held a small distance away from the smoker's mouth to prevent burning of the smoker's lips.

Few improvements have been made which would obviate these problems. One improvement is exemplified in U.S. Pat. No. 4,033,358 (Harrington). In this patent, a cigarette paper is provided with an integral cigarette holder which is simply a wire permanently mounted along one longitudinal edge of the cigarette paper. As the cigarette is consumed, more of the wire is exposed, thereby allowing the smoker to use the exposed wire as a holder. However, the integral cigarette paper holder elements disclosed by Harrington are not reusable because the papers come prefabricated with the wire, thereby necessitating the disposal of the wire after consumption of the cigarette.

No other devices exist in the prior art which completely solve the problem of providing longitudinal strengthening of a cigarette with a reusable device that also functions as a cigarette holder and rolling guide. Accordingly, it is the principal object of the present invention to longitudinally strengthen manually-prepared cigarettes, while simultaneously providing a holder for such cigarettes.

It is another object of the present invention to provide a reusable device which provides a rolling guide for manually prepared cigarettes, which longitudinally strengthens the cigarette, and which also functions as a cigarette holder.

It is another object of the present invention to provide a cigarette rolling, strengthening, and holding device which is usable with all cigarette papers commercially available.

It is another object of the present invention to prevent burning of a smoker's mouth with a cigarette in the final stages of consumption.

SUMMARY OF THE INVENTION

The present invention, in a broad aspect, provides a reusable device for rolling a cigarette from a generally rectangular cigarette paper and for holding the rolled cigarette during use. The device includes an elongated member which supports one longitudinal edge of the paper, and a curved member, adjacent the elongated member for crimping a transverse edge of the paper. The elongated member provides a rolling guide for the cigarette, and also provides a support for the cigarette after rolling, while additionally providing a holder for the cigarette as the elongated member is exposed as the cigarette is consumed by smoking. The curved member crimps the transverse edge of the rolling paper to prevent movement of the elongated member during the rolling and the smoking of the cigarette.

In accordance with one feature of the invention, the elongated member and the hooked member comprise a continuous thin and rigid wire of noncombustible material. The wire is folded into the longitudinal edge of the paper prior to the rolling of the cigarette, with the hook engaging the transverse end of the paper from which the cigarette is smoked. As the smoking occurs, the wire is increasingly exposed, with the exposed portion providing a holder for the cigarette. The hook prevents the disengagement of the cigarette from the paper. After the cigarette has been completely consumed, the wire is completely exposed and may be used with other cigarettes.

In accordance with another feature of the invention, a novel method of rolling and supporting a cigarette is provided in which the wire is folded into the longitudinal edge of the paper prior to the rolling of the cigarette, with the hook crimping a transverse edge of the paper. The wire thus acts as a rolling guide for the paper as the paper is rolled inwardly from the longitudinal edge around tobacco. The cigarette is then manually supported during the initial stages of smoking, with the smoking increasingly exposing the wire. The cigarette is then supported by the wire during the final stages of consumption to prevent the singeing of the smoker's fingers. The smoker need only maintain the hook in crimping engagement with the cigarette paper to obtain complete use of the cigarette. After the cigarette has been consumed, the wire may be reused.

Other objects, features, and advantages of the present invention will become apparent from a consideration of the following detailed description and from the accompanying drawings.

DETAILED DESCRIPTION

Figure 1:
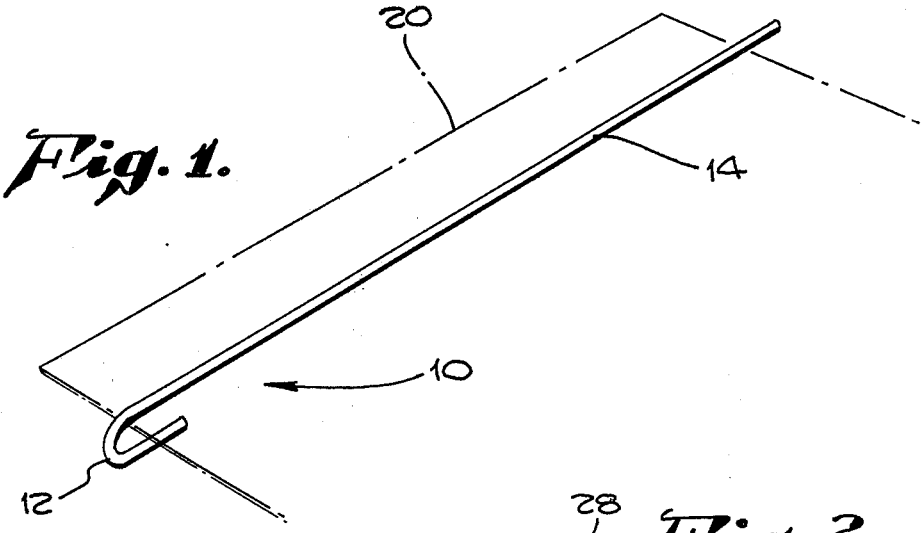
FIG. 1 shows a perspective view of a cigarette rolling and holding device according to the present invention.

Referring more particularly to the drawings, FIG. 1 shows a perspective view of a novel cigarette rolling and supporting device 10 according to the present invention. Generally stated, the device 10 includes thin elongated portion 14 integral with a curved or hooked section 12. The device 10 may be made of any rigid material such as music wire or the like so long as the material can be made to have a hook 12 at one end connected to an elongated portion 14. In a working model of the invention, the device 10 had an overall length of approximately 2.5 inches with the hooked portion 12 being approximately 0.1875 inches in length and approximately 0.045 inches from the elongated portion 14. The device was constructed out of 0.021 inch gauge wire.

Figure 2:
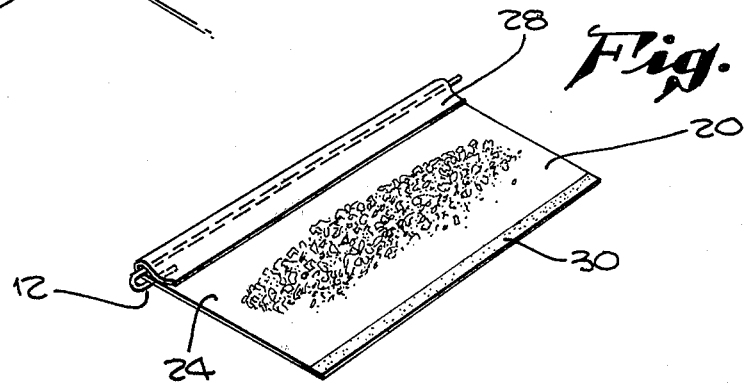
FIG. 2 shows the positioning of the device of FIG. 1 in a cigarette paper prior to the rolling of tobacco within the cigarette paper to form a cigarette.

FIG. 2 shows the use of the device 10 and the rolling of a cigarette. As shown therein, the device 10 is placed at one longitudinal edge 28 of the paper 20, with the edge 28 being folded over the device 10 several times. The hook 12 at the end of the device is placed over the end 22 of the paper 20 which is to be closest to the smoker's mouth as the device is used.

Once the device has been positioned as shown, the cigarette is made by rolling the folded edged 28 containing the device 10 inwardly and around tobacco 24 placed upon the paper 20. As this occurs, the wire adds support to the paper 20 to provide a very evenly rolled cigarette. Additionally, the hook 12 at the end prevents longitudinal movement of the device 10 along the edge of the paper 20. The making of the cigarette is completed by the moistening of a gummed edge 30 and the attaching of this edge to the rolled portion of the paper.

It should be noted that the device 10 may be used to either manually roll cigarettes or may be used in a rolling machine. Furthermore, the device 10 is compatible with all rolling papers currently manufactured.

Figure 3:
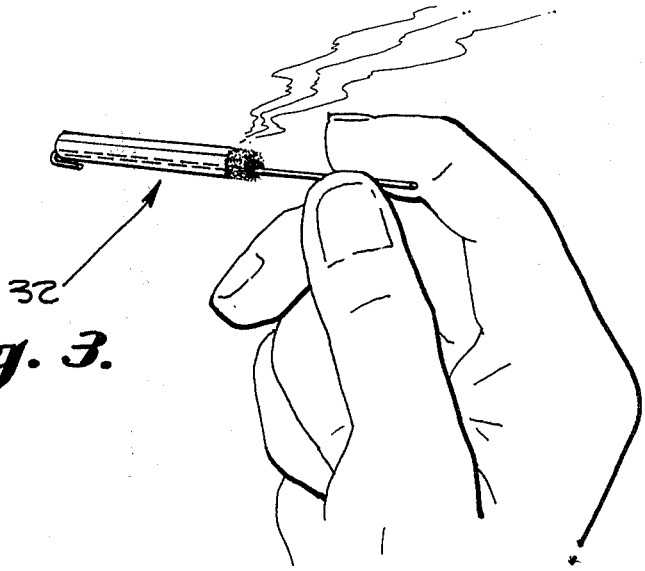
FIG. 3 shows the use of the device of FIG. 1 to hold a cigarette as the cigarette is consumed.

FIG. 3 shows the use of the device 10 to support a cigarette during the smoking thereof. As shown therein, the cigarette 32 is lit at the end opposite the hook 12. As the cigarette burns, an increasing part of the elongated section 14 of the device 10 is exposed. Accordingly, the elongated portion 14 may be used as a support for the cigarette as it is burned. The hook 12 prevents the slipping of the cigarette 32 along the elongated member 14 during the smoking of the cigarette. Furthermore, if the cigarette 32 should start to slip along the device 10, all the user has to do is to hold the cigarette 32 in one hand and slightly pull on the elongated member until the transverse edge of the paper 22 is again crimped in the hook portion 12. Accordingly, there is no danger that the smoker's fingers will be singed by the burning cigarette. Additionally, the material from which the device 10 is made preferably has low heat conductivity, as is the case with most rigid wire materials. This prevents the heat at the end of the cigarette from being transferred either to the elongated portion 14 or to the hook portion 12.

The rigidity of the material used for the device 10 prevents the cigarette 32 from putting any substantial strain upon it. Thus, after the cigarette 32 has been consumed, the device 10 may be reused with other cigarettes.

One additional advantage of the present invention is that it is small enough to be carried on the back of most standard rolling paper packages, thereby increasing its consumer appeal. This feature, when combined with the fact that the device may be produced at a very low cost should not only make it attractive for use by those who prefer to roll their own cigarettes, but should also make the possibility of custom made cigarettes more desirable to the those who currently purchase the commercial brands.

In the foregoing description of the present invention, a preferred embodiment of the invention has been disclosed. It is to be understood that other mechanical and design variations are within the scope of the present invention. Thus, by way of example and not of limitation, the elongated portion of the device 10 could be of a greater length than the longitudinal edge of a standard cigarette paper; the hooked portion could be of a different dimension relative to the elongated portion; and the device could be made of different materials than described herein. Accordingly, the invention is not limited to the particular embodiment which has been illustrated and described in detail herein.

What is claimed is:

1. A method of rolling a cigarette from a generally rectangular cigarette paper and for supporting said cigarette during the consumption thereof by smoking, comprising:

placing an elongated member adjacent one longitudinal edge of said paper prior to said rolling;

simultaneously placing a curved member attached to said elongated member in engaging relation with a transverse edge of said paper adjacent said longitudinal edge prior to said rolling;

folding said longitudinal edge over said elongated member;

rolling said paper inwardly from said longitudinal edge to form said cigarette, while simultaneously maintaining said curved member in crimping engagement with said transverse edge to prevent movement of said elongated member during said rolling;

manually supporting said cigarette during the initial stages of consumption, said consumption increasingly exposing said elongated member;

supporting said cigarette by said elongated member during the final stages of consumption to prevent singeing of the smoker's fingers, while maintaining said curved member in crimping engagement with said transverse edge to prevent movement of said longitudinal member; and retaining said curved member and said elongated member after consumption of said cigarette for reuse.

2. A method as defined in claim 1 wherein said steps of placing an elongated member against one longitudinal edge of said paper and simultaneously placing a curved member in engaging relation with an adjacent transverse edge of said paper comprise the single step of placing a thin elongated member having a hook at one end in contact with said paper, whereby said elongated member contacts said longitudinal edge of said paper and said hook engages an adjacent transverse edge of said paper.

3. A method as defined in claim 2, wherein said maintaining of said curved member in crimping engagement with said transverse edge comprises manual pulling by said smoker on said elongated member to maintain said hook in crimping engagement with said transverse edge of said paper.

* * * * *